US009017109B2

(12) United States Patent
Gotou et al.

(10) Patent No.: US 9,017,109 B2
(45) Date of Patent: Apr. 28, 2015

(54) PROTECTOR-ATTACHED CONNECTOR

(71) Applicant: Yazaki Corporation, Tokyo (JP)

(72) Inventors: Hiroki Gotou, Shizuoka (JP); Ryohei Toyoda, Shizuoka (JP); Takanori Kawai, Aichi (JP); Yoshiyuki Ishihara, Aichi (JP)

(73) Assignee: Yazaki Corporation, Tokyo (JP)

( * ) Notice: Subject to any disclaimer, the term of this patent is extended or adjusted under 35 U.S.C. 154(b) by 90 days.

(21) Appl. No.: 13/870,116

(22) Filed: Apr. 25, 2013

(65) Prior Publication Data

US 2013/0303032 A1 Nov. 14, 2013

(30) Foreign Application Priority Data

May 9, 2012 (JP) ..... 2012-107654

(51) Int. Cl.

| | |
|---|---|
| ***H01R 13/518*** | (2006.01) |
| ***H01R 13/52*** | (2006.01) |
| ***H01R 13/56*** | (2006.01) |
| ***H01R 13/58*** | (2006.01) |

(52) U.S. Cl.

CPC ..... *H01R 13/5213* (2013.01); *H01R 13/518* (2013.01); *H01R 13/562* (2013.01); *H01R 13/5812* (2013.01)

(58) Field of Classification Search

USPC ..... 439/718, 471, 470, 464, 460, 461, 462

See application file for complete search history.

(56) References Cited

U.S. PATENT DOCUMENTS

| | | | | |
|---|---|---|---|---|
| 3,638,169 | A * | 1/1972 | Caveney et al. | 439/471 |
| 3,732,526 | A * | 5/1973 | Punako | 439/471 |
| 3,936,129 | A * | 2/1976 | Guy | 439/464 |
| 6,478,609 | B1 * | 11/2002 | Davis et al. | 439/470 |
| 7,201,609 | B2 * | 4/2007 | Ishikawa | 439/587 |
| 7,479,027 | B1 * | 1/2009 | Miller et al. | 439/461 |
| 7,618,280 | B2 * | 11/2009 | Horst | 439/460 |
| 2006/0178049 | A1 * | 8/2006 | Ishikawa | 439/587 |
| 2009/0093153 | A1 | 4/2009 | Tachi et al. | |

FOREIGN PATENT DOCUMENTS

| | | | |
|---|---|---|---|
| DE | 42 01 390 | A1 | 7/1993 |
| EP | 2 590 271 | A1 | 5/2013 |
| JP | 2010-55863 | A | 3/2010 |
| JP | 2011-86396 | A | 4/2011 |
| WO | 2010/139550 | A1 | 12/2010 |

OTHER PUBLICATIONS

The extended European Search Report for the related European Patent Application No. 13165054.1 dated Aug. 12, 2013.

* cited by examiner

*Primary Examiner* — Alexander Gilman
(74) *Attorney, Agent, or Firm* — Kenealy Vaidya LLP

(57) ABSTRACT

Herein disclosed is a protector-attached connector which includes a connector which accommodates terminals which are connected to ends of a group of electric wires, and a protector whose opening end is fitted to the rear end of the connector and which protects the group of electric wires which is derived from the rear of the connector, wherein a groove into which a binding band is mounted is formed at the opening end of the protector along a circumferential direction, a gap, which is formed when the opening end is fitted to the rear end of the connector, is provided at a part of the opening end in the circumferential direction along which the groove is formed, and the width of the gap is narrowed by a binding force of the binding band which is mounted into the groove.

8 Claims, 8 Drawing Sheets

PROTECTOR-ATTACHED CONNECTOR

BACKGROUND OF THE INVENTION

The present invention relates to a protector-attached connector in which a protector is mounted to a connector.

A protector-attached connector has such a construction that a group of electric wires such as a wire harness which is derived from the rear of a connector is accommodated and protected by a protector, and axial movement is regulated by a rubber boot which is connected to the protector.

As an example of the protector-attached connector, for example, as shown in FIG. 8A, a construction that a protector 2 is mounted to a connector 1 is taken. In this case, as shown in FIG. 8B, which is a sectional view along the d-d line of FIG. 8A, an opening part 2*a* of the protector 2 is fitted with a rear end 1*a* of the connector 1. However, there are variations in the shape of the connector 1 and the shape of the protector 2, respectively.

Therefore, when the variations are considered, it is necessary to form a predetermined gap 3 between the rear end 1*a* of the connector 1 and the opening part 2*a* of the protector 2. Once such a gap 3 is formed, when the opening part 2*a* of the protector 2 is fitted with the rear end 1*a* of the connector 1, not only there may be a wobble between the end 1*a* of the connector 1 and the opening part 2*a* of the protector 2, but also water may enter from the gap 3. Further, when water enters from the gap 3, an internal corrosion may occur, and a short circuit of the group of electric wires may occur.

To solve such a problem, for example, a cover-attached connector is known which is shown in a patent literature 1. The cover-attached connector has such a construction that a connector housing is formed with a locked part, an open/close locking plate is integrally formed through a hinge part at one of two side parts of the cover body of a cover, and the locked part of the connector housing is pressed and biased to a locking part of the cover body by the open/close locking plate.

CITATION LIST

Patent Literature

[Patent Reference 1] Japanese Patent Publication No. 2010-55863

In the cover-attached connector shown in the above-mentioned patent reference 1, since the locking part of the cover body is pressed and biased by the open/close locking plate, there can be no clearance between the locked parts of the connector housing and the cover, and the part where the connector housing is fitted with the cover will not wobble.

However, for the cover-attached connector, although there is no clearance between the locked parts of the connector housing and the cover, and there is no wobble at the fitted part, since the open/close locking plate is integrally formed through the hinge part at one of the two side parts of the cover body of the cover, the cover body is formed with the locking part, and the locked part of the connector housing is locked the locking part of the cover body, there is a problem that the structure in order to fit the connector housing and the cover body without a wobble becomes complicated.

The present invention is made in view of the situation, and the present invention is intended to provide a protector-attached connector so that a wobble of the fitted part of the connector and the protector can be surely eliminated with a simple structure.

It is therefore an aspect of the invention to provide A protector-attached connector, including a connector for accommodating terminals which are connected to ends of a group of electric wires, and a protector whose opening end is fitted to a rear end of the connector, for protecting the group of electric wires which is derived rearward of the connector, wherein a groove into which a binding band is mounted is formed at the opening end of the protector along a circumferential direction, a gap, which is formed when the opening end is fitted to the rear end of the connector, is provided at a part of the opening end in the circumferential direction along which the groove is formed, and width of the gap is narrowed by a binding force of the binding band when the binding band is mounted into the groove.

The protector-attached connector may further comprise a rubber boot which is connected to the protector, for regulating axial movement of the group of electric wires, wherein a distal end section of the rubber boot is placed inside the protector, and the distal end of the rubber boot is arranged between an inner side of the opening end of the protector and the rear end of the connector, and the inner side of the opening end of the protector is pushed to the rear end of the connector through the distal end of the rubber boot by the binding force of the binding band which is mounted into the groove.

The protector-attached connector may further comprise a locking frame to which a locking part of a band body of the binding band is locked while the band body of the binding band is inserted to a part of the groove.

The protector may be constructed by a cover and a protector body which are vertically divided in a direction perpendicular to the thickness direction, and gaps which are formed when the opening end is fitted to the rear end of the connector are formed at a part where the cover and the protector body is bonded.

The protector-attached connector may further comprise a rubber boot which is connected to the protector and which regulates the axial movement of the group of electric wires, wherein the distal end section of the rubber boot is placed inside the protector, and the distal end of the rubber boot is arranged between the inner side of the opening end of the protector and the rear end of the connector, and the inner side of the opening end of the protector is pushed to the rear end of the connector through the distal end of the rubber boot by the binding force of the binding band which is mounted into the groove.

A locking frame to which a locking part of a band body of the binding band may be locked while the band body of the binding band is inserted to a part of the groove, is provided.

The protector may be constructed by a cover and a protector body which are vertically divided in a direction perpendicular to the thickness direction, and gaps which are formed when the opening end is fitted to the rear end of the connector are formed at a part where the cover and the protector body is bonded.

For the protector-attached connector of the present invention, when the binding band is mounted into the grooves formed along the circumferential direction at the opening end of the protector and the binding band is bound, the widths of the gaps which are provided at parts of the opening end of the protector in the circumferential direction along which the grooves are formed are narrowed, and the inner side of the opening end of the protector is pushed to the rear end side of the connector.

According to the protector-attached connector of the present invention, when the binding band is mounted into the grooves formed along the circumferential direction at the opening end of the protector and the binding band is bound, the widths of the gaps which are provided at parts of the opening end of the protector in the circumferential direction along which the grooves are formed are narrowed, and the inner side of the opening end of the protector is pushed to the rear end side of the connector. Therefore, a wobble of the fitted part of the connector and the protector can be surely eliminated with a simple structure.

BRIEF DESCRIPTION OF THE DRAWINGS

FIGS. 6A and 6B are figures which show the protector-attached connector of FIGS. 4 and 5, in which FIG. 6A is a sectional view along the a-a line of FIG. 4, and FIG. 6B is a sectional view along the c-c line of FIG. 5.

FIGS. 8A and 8B show a traditional protector-attached connector, in which FIG. 8A is a top view which shows the protector-attached connector, and FIG. 8B is a sectional view along the d-d line of the FIG. 8A.

DETAILED DESCRIPTION OF EMBODIMENTS

The details of one embodiment of the protector-attached connector of the present invention are described with reference to FIGS. 1 to 7 as follows. The protector-attached connector described below is used, for example, to protect or route a group of electric wires such as a wire harness which is wired in a vehicle.

Figure 1:
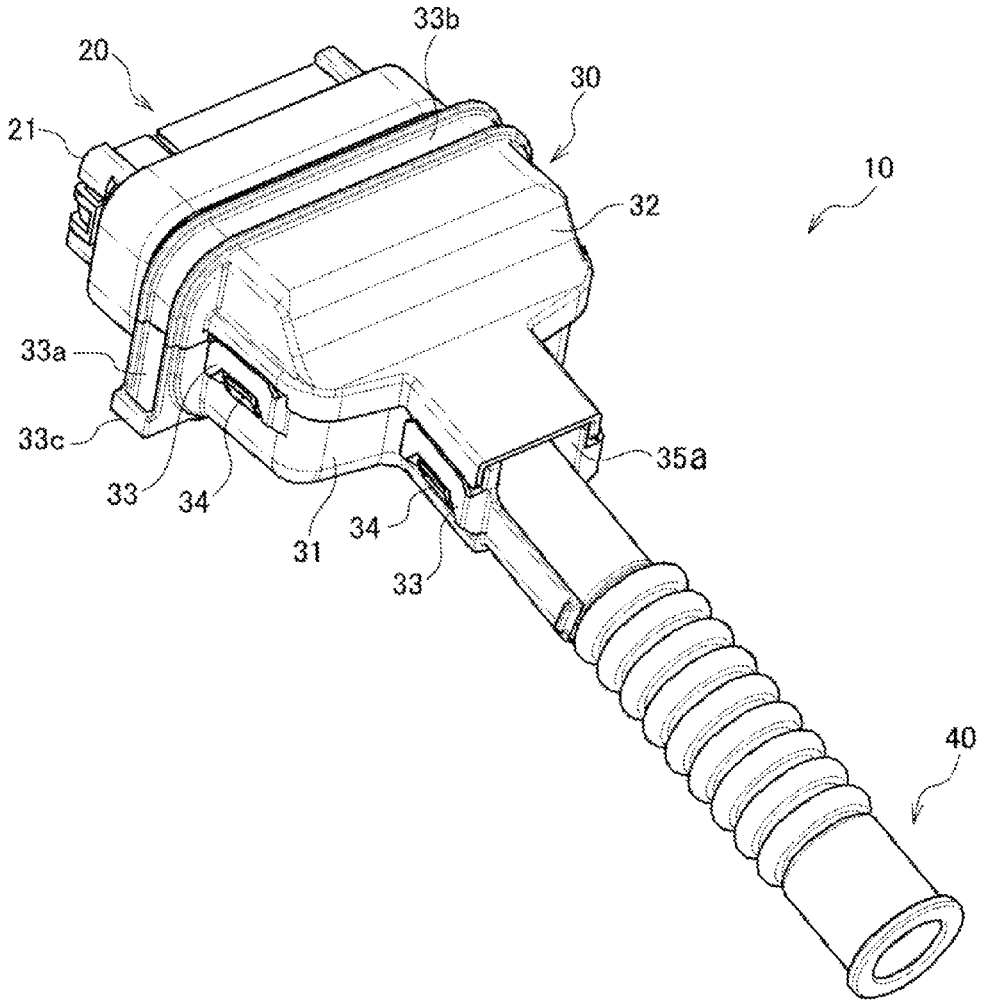
FIG. 1 shows one embodiment of the protector-attached connector of the present invention, and is a perspective view which shows that a connector, a protector and a rubber boot are integrated.
Figure 2:
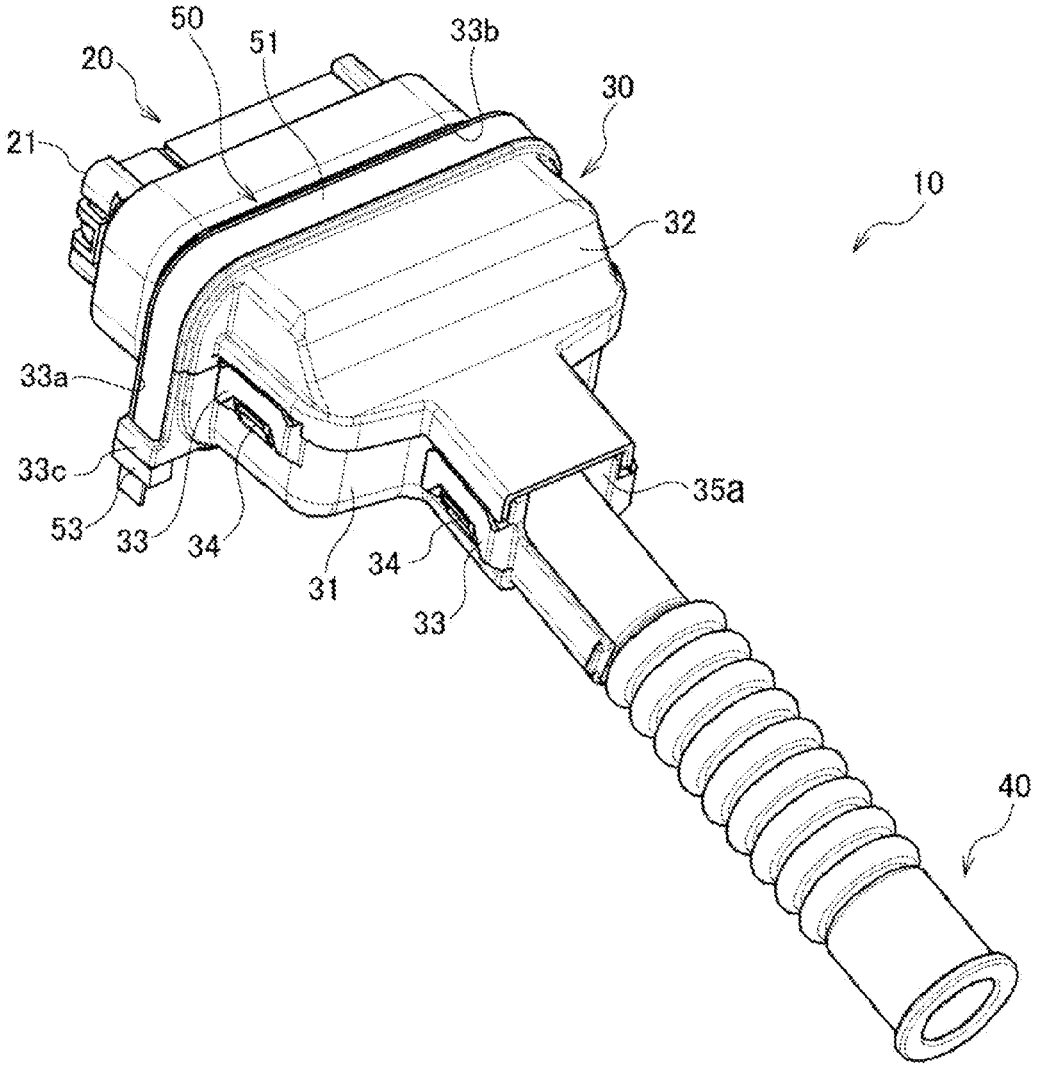
FIG. 2 is a perspective view which shows that a binding band is mounted to the protector of the protector-attached connector of FIG. 1.

At first, as shown in FIGS. 1 and 2, a protector-attached connector 10 includes a connector 20, a protector 30 and a rubber boot 40. The connector 20 and the protector 30 are insert molding articles.

The connector 20 accommodates the ends of a group of electric wires not shown in the figure, and is integrally constructed. The connector 20 has such a construction that terminals at the ends of the group of electric wires are arranged at the side of an opening end 21. The inside of the opening end of the protector 30 is fitted to the side of the rear end of the connector 20. The protector 30 accommodates and protects electric wires (not shown in the figure) which are derived from the rear of the protector 20, and is divided vertically in a direction perpendicular to the thickness direction to have a protector body 31 and a cover 32.

The left side surface of the protector body 31 in the widthwise direction is formed with locking frame parts 33 to which locking pawls 34 to be described later are locked. Although not shown in FIGS. 1 and 2, the right side surface of the protector body 31 in the widthwise direction is also formed with locking frame parts 33. A groove 33*a* to which a binding band 50 is mounted is formed at the distal end side (the side where the rear end of the connector 20 is fitted) of the protector body 31. A locking frame 33*c* to which a locking part 53 is locked while a band body 51 of the binding band 50 is inserted through the groove 33*a* is provided. The locking frame 33*c* may be provided at the side of a groove 33*b* to be described later.

On the other hand, the locking pawls 34 which are locked to the locking frame parts 33 of the protector body 31 are provided at the opening edge of the cover 32 opposite to the band body 51. The groove 33*b* to which the binding band 50 is mounted is formed at the distal end side (the side where the rear end of the connector 20 is fitted) of the cover 32. When the cover 32 is mounted to the protector body 31, the grooves 33*a* and 33*b* communicate in the circumferential direction of the opening edges of the protector body 31 and the cover 32.

When the binding band 50 is mounted into these grooves 33*a* and 33*b*, a position deviation of the binding band 50 is prevented. When the locking part 53 of the band body 51 is locked while the band body 51 of the binding band 50 is inserted into the above-described locking frame 33*c*, and a position deviation of the binding band 50 along the grooves 33*a* and 33*b* is prevented.

Figure 6A:
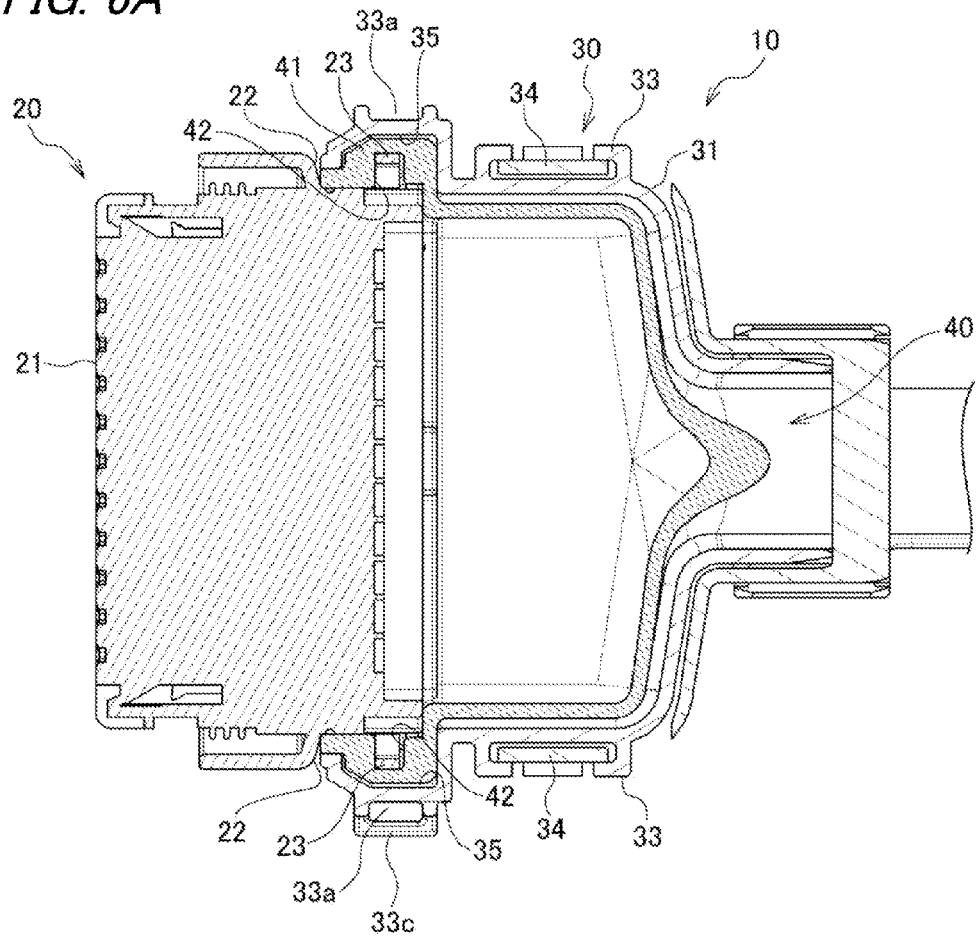
Figure 6B:
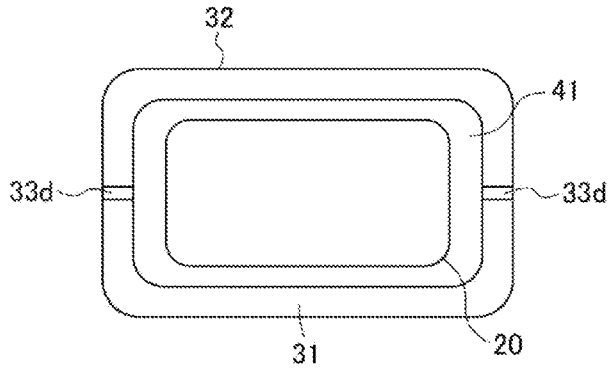

As shown in FIG. 6B, gaps 33*d* are provided at parts of the opening edges of the protector body 31 and the cover 32 in the circumferential direction along which the grooves 33*a* and 33*b* are formed. The gaps 33*d* are formed when the opening end of the protector 30 is fitted to the rear end side of the connector 20, and are formed at parts where the parts where the grooves 33*a* and 33*b* of the protector body 31 and the cover 32 are formed are bonded. The gaps are narrowed by a binding force of the binding band 50. Thereby, the inner side of the opening edges of the protector body 31 and the cover 32 is pushed to the rear end side of the connector 20. The gaps 33*d* are not limited to the parts in the circumferential direction along which the grooves 33*a* and 33*b* are formed, but may be formed throughout the bonding part of the cover 32 and the protector body 31 which are vertically divided in a direction perpendicular to the thickness direction.

A drawing hole 35*a* of the rubber boot 40 is formed at the rear end side of the protector body 31 and the cover 32. The rubber boot 40 regulates the movement of the electric wires not shown in the figure in the longitudinal direction which are accommodated and protected by the protector 30. The distal end section of the rubber boot 40 is placed inside the protector 30, and a distal end 41 of the rubber boot 40 to be described later is arranged between the inner side of the opening end of the protector and the rear end of the connector 20. The details of a state that the connector 20 and the protector 30 are fitted and a state that the rubber boot 40 is mounted will be described later.

Figure 3:
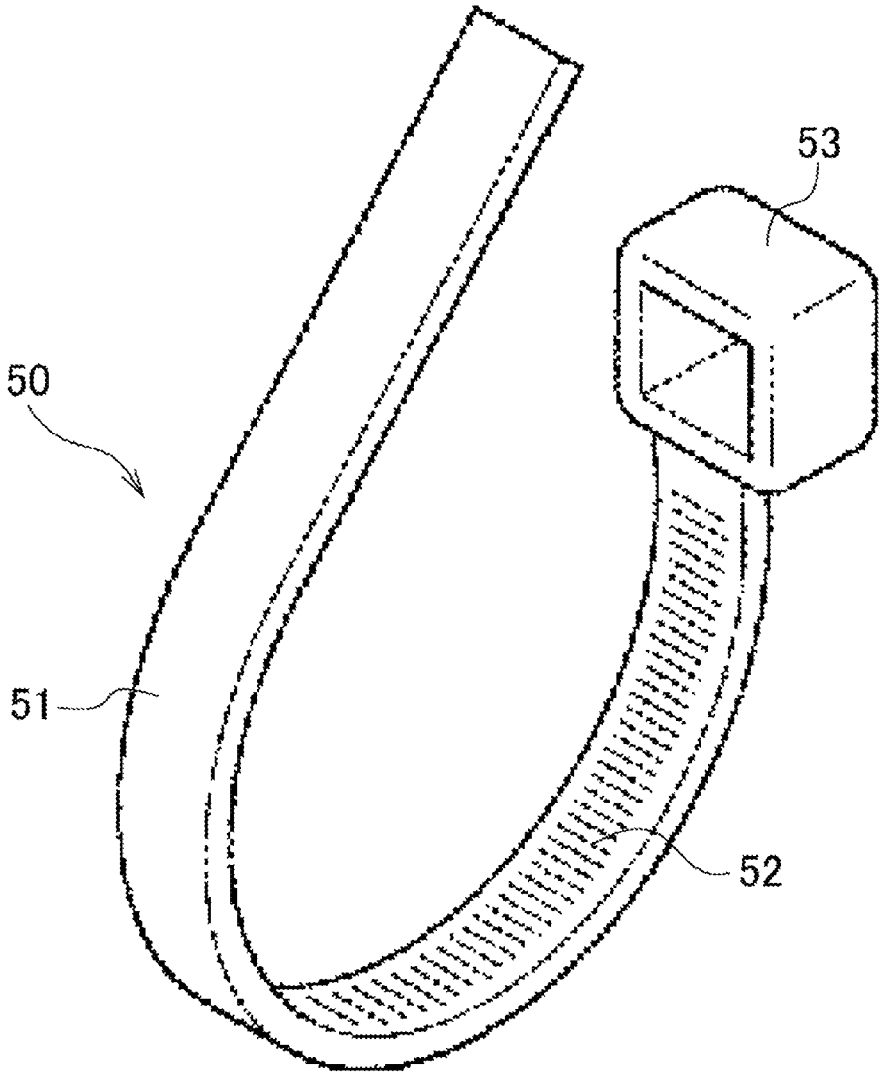
FIG. 3 is a perspective view which shows the binding band of FIG. 2.

For example, the binding band 50 as shown in FIG. 3 is mounted into the above-mentioned grooves 33*a* and 33*b*. The binding band 50 includes the band body 51 which has a plurality of hook parts 52 on the inner surface, and the rectangular frame-like locking part 53 which removably locks the hook part 52 at an arbitrary position when the band body 51 is inserted.

Then, a state that the connector 20 and the protector 30 are fitted and a state that the rubber boot 40 is mounted are described. First, a state that the rear end of the connector 20 is fitted in the widthwise (left-right) direction is described.

Figure 4:
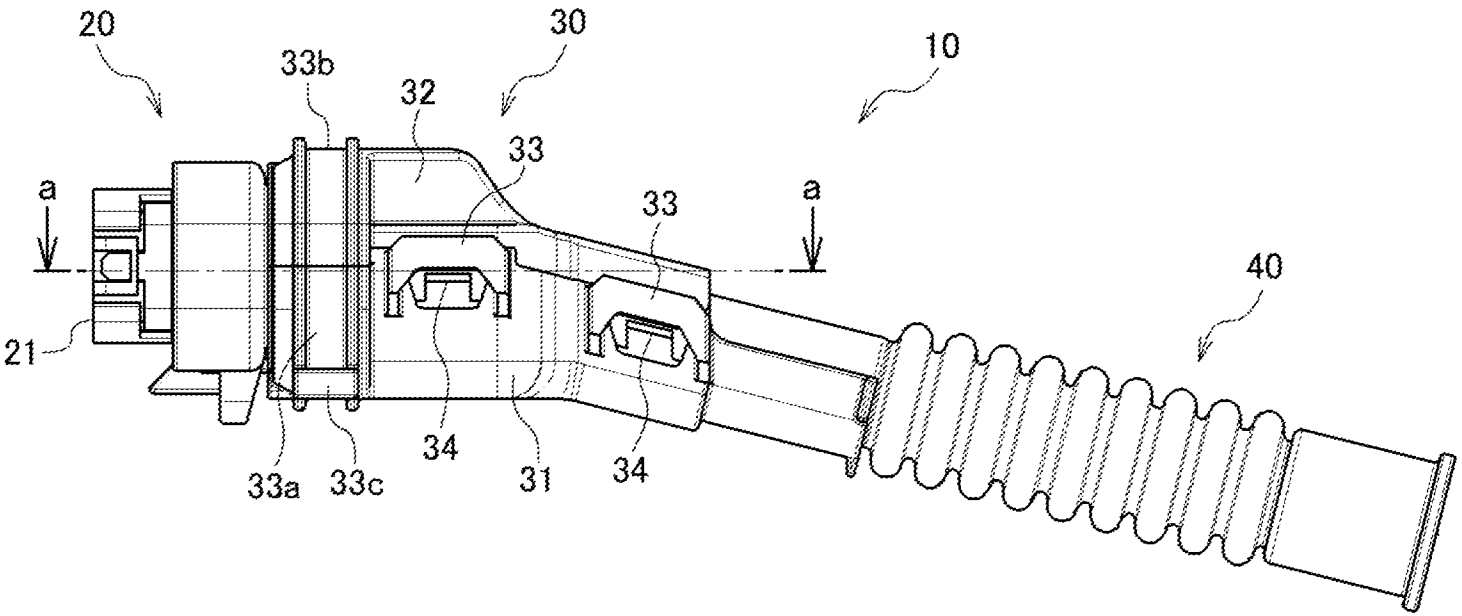
FIG. 4 is a side view which shows the protector-attached connector of FIG. 1.

That is, as shown in FIG. 4 and FIG. 6A which is a sectional view along the a-a line of FIG. 4, the left and right rear ends of the connector 20 in the widthwise direction are provided with engaging steps 22 along the circumferential direction. The left and right sides of the rear end of the connector 20 in the widthwise direction are provided with engaging pieces 23. These engaging pieces 23 are protruded towards the inner sides of the left and right distal ends (in the widthwise direction) of the protector body 31 opposite to the groove 33*a*.

These engaging pieces 23 are adapted to be engaged in engaging grooves 42 of the distal end 41 of the rubber boot 40 to be described later. Thereby, a position deviation of the distal end 41 of the rubber boot 40 is inhibited.

On the other hand, the inner sides of the left and right distal ends (in the widthwise direction) of the protector body 31 opposite to the groove 33*a* are provided with accommodating recesses 35 which accommodate and hold the distal end 41 of the rubber boot 40. The accommodating recesses 35 are assumed as parts where the left and right (in the widthwise direction) rear ends of the connector 20 are fitted. The left and right (in the widthwise direction) inner sides of the distal end 41 of the rubber boot 40 are provided with the engaging grooves 42 where the above-mentioned engaging pieces 23 are engaged. The distal end of the rubber boot 40 abuts with the left and right (in the widthwise direction) engaging steps 22 of the connector 20.

Because the left and right (in the widthwise direction) distal ends 41 of the rubber boot 40 are between the left and right (in the widthwise direction) rear ends of the connector 20 and the accommodating recesses 35 of the left and right (in the widthwise direction) distal ends of the protector body 31, the space between the left and right (in the widthwise direction) rear ends of the connector 20 and the left and right (in the widthwise direction) distal ends of the protector body 31, namely, the left and right (in the widthwise direction) fitted parts of the connector 20 and the protector body 31 are sealed by the distal end 41 of the rubber boot 40.

Figure 5:
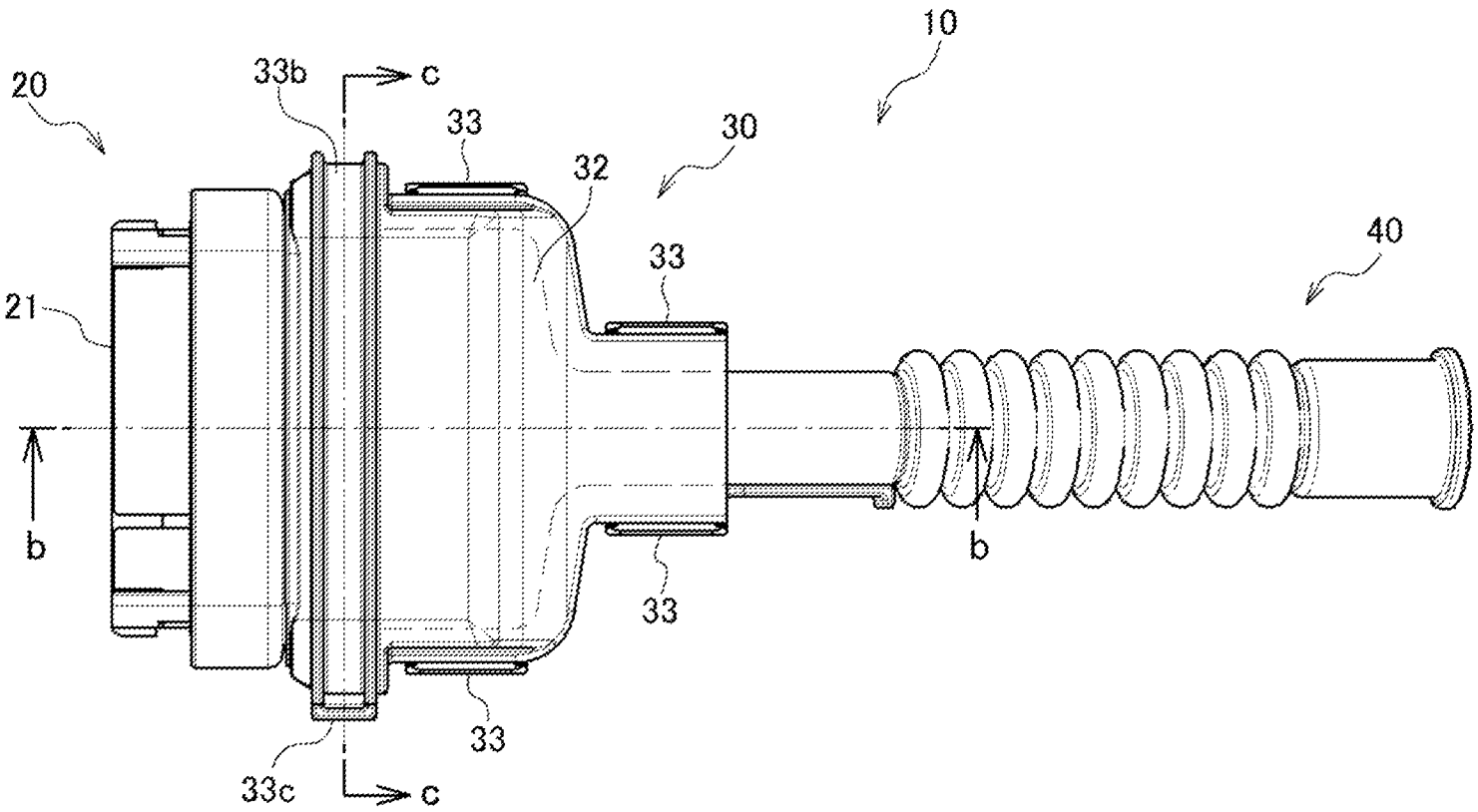
FIG. 5 is a top view which shows the protector-attached connector of FIG. 1.
Figure 7:
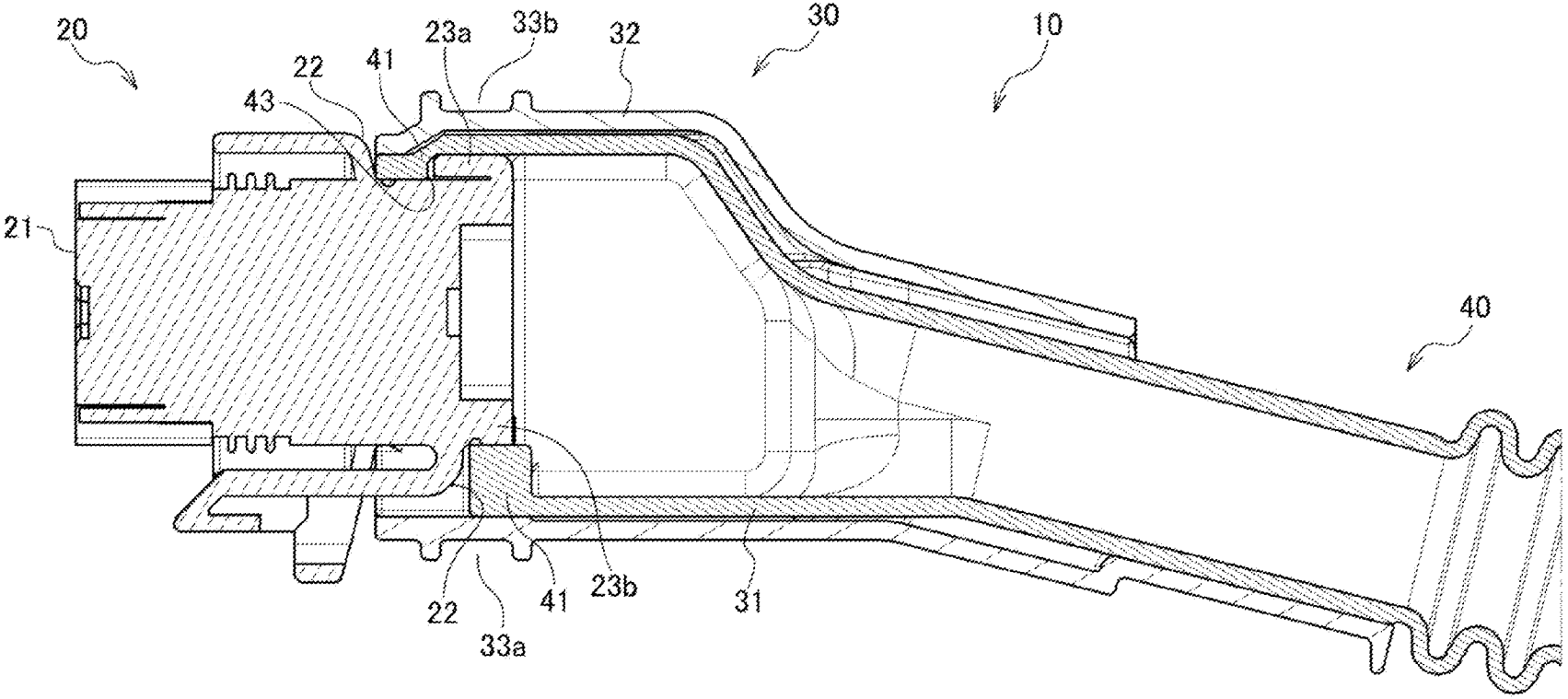
FIG. 7 is a sectional view along the b-b line of FIG. 5.
Figure 8A:
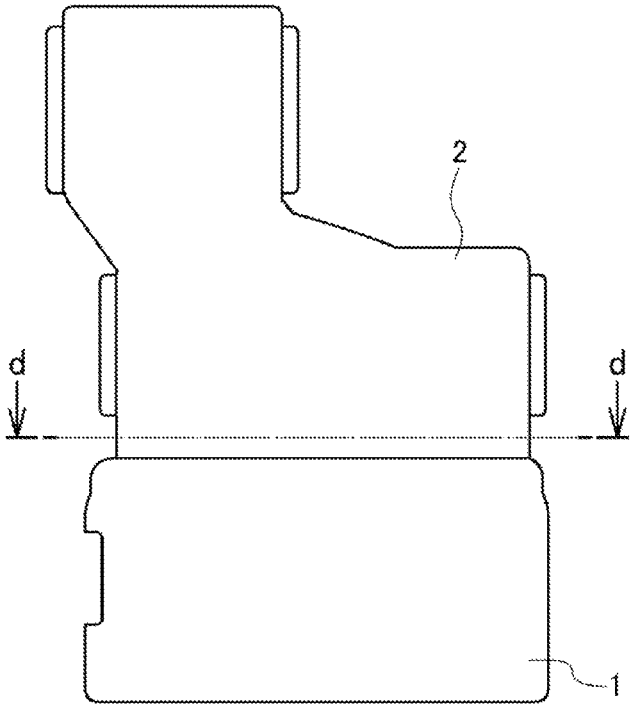
Figure 8B:
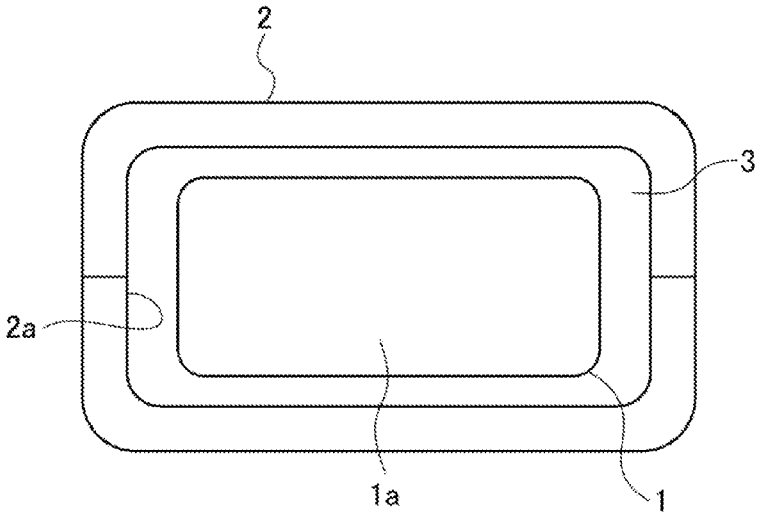

When a state that the rear end of the connector 20 is vertically fitted in the thickness direction is described, as shown in FIG. 5 and FIG. 7 which is a section view along the b-b line of FIG. 5, the upper and lower (in the thickness direction) rear ends of the connector 20 are provided with the above-mentioned engaging steps 22. The upper (in the thickness direction) rear end of the connector 20 is provided with a folded piece 23*a*. The lower (in the thickness direction) rear end of the connector 20 is provided with an abutting step 23*b*.

On the other hand, the inner side of the distal end of the cover 32 opposite to the groove 33*b* corresponds to the upper (in the thickness direction) folded piece 23*a* of the connector 20. The distal end of the rubber boot 40 is pinched between the inner side opposite to the groove 33*b* and the folded piece 23*a*. The distal end of the rubber boot 40 abuts with the upper (in the thickness direction) engaging step 22 of the connector 20.

The distal end 41 of the rubber boot 40 is provided with an engaging step 43 which is engaged to the distal end of the folded piece 23*a*. Thereby, the space between the inner side opposite to the groove 33*b* and the folded piece 23*a*, namely, the upper (in the thickness direction) fitted part of the connector 20 and the cover 32 is sealed by the distal end 41 of the rubber boot 40 due to the binding force of the above-mentioned binding band 50.

On the other hand, the inner side of the distal end of the protector body 31 opposite to the groove 33*a* corresponds to the lower (in the thickness direction) abutting step 23*b* of the connector 20. The distal end 41 of the rubber boot 40 is pinched between the inner side opposite to the groove 33*a* and the abutting step 23*b*. The distal end of the rubber boot 40 abuts with the lower (in the thickness direction) engaging step 22 of the connector 20.

Thereby, the space between the inner side opposite to the groove 33*a* and the abutting step 23*b*, namely, the lower (in the thickness direction) fitted part of the connector 20 and the protector body 31 is sealed by the distal end 41 of the rubber boot 40 due to the binding force of the above-mentioned binding band 50.

Thus, in the present embodiment, when the binding band 50 is mounted into the grooves 33*a* and 33*b* formed along the circumferential direction at the opening end of the protector 30 and the binding band 50 is bound, the widths of the gaps 33*d* which are provided at parts of the opening end of the protector 30 in the circumferential direction along which the grooves 33*a* and 33*b* are formed are narrowed. Thereby, because the inner side of the opening end of the protector 30 is pushed to the rear end side of the connector 20, the wobble of the fitted part of the connector 20 and the protector 30 can be surely eliminated with a simple structure.

In the present embodiment, when the binding band 50 is mounted into the grooves 33*a* and 33*b* formed along the circumferential direction at the opening end of the protector 30 and the binding band 50 is bound, the widths of the gaps 33*d* which are provided at parts of the opening end of the protector 30 in the circumferential direction along which the grooves 33*a* and 33*b* are formed are narrowed, and the inner side of the opening end of the protector 30 is pushed to the rear end side of the connector 20 through the rubber boot 40 whose distal end 41 is arranged between the inner side of the opening end of the protector 30 and the rear end of the connector 20. Thereby, because the space between the inner side of the opening end of the protector 30 and the rear end of the connector 20 is sealed, the wobble of the fitted part of the connector 20 and the protector 30 is eliminated, and water can be surely prevented from entering from the fitted part of the connector 20 and the protector 30.

Because the binding band 50 is mounted into the grooves 33*a* and 33*b*, a position deviation of the binding band 50 can be prevented.

In the present embodiment, because the locking frame 33*c*, to which the locking part 53 of the band body 51 is locked while the band body 51 of the binding band 50 is inserted into, for example, the groove 33*a*, is provided, a position deviation of the binding band 50 along the grooves 33*a* and 33*b* can be prevented.

When the gaps 33*d*, which are formed when the opening end of the protector 30 is fitted to the rear end of the connector 20, are provided throughout the bonding part of the cover 32 and the protector body 31 which are vertically divided in a direction perpendicular to the thickness direction of the protector 30, even if there are variations in the shape of the connector 20 and in the shape of the protector 30, respectively, the respective variations can be allowed.

For example, the present invention is applicable in the protection or course regulation of a group of electric wires such as a wire harness which is wired in a vehicle. Besides, the present invention is applicable in the protection or course regulation of power lines or signal lines.

What is claimed is:

1. A protector-attached connector, comprising a connector for accommodating terminals which are connected to ends of a group of electric wires, a binding band, and a protector having an opening end that is fitted to a rear end of the connector, for protecting the group of electric wires which is derived rearward of the connector, a groove into which the binding band is mounted being formed at the opening end of the protector along a circumferential direction, wherein:

the protector has two pairs of opposing surfaces that extend in a direction that is perpendicular to the connecting direction at a part of the opening end in the circumferential direction along which the groove is formed and a pair of gaps are formed by the two pairs of opposing surfaces when the opening end is fitted to the rear end of the connector, and widths of the gaps are concurrently and correspondingly narrowed by a binding force of the binding band when the binding band is mounted into the groove.

2. The protector-attached connector according to claim 1, further comprising a rubber boot which is connected to the protector, for regulating axial movement of the group of electric wires, wherein a distal end section of the rubber boot is placed inside the protector, and the distal end of the rubber boot is arranged between an inner side of the opening end of the protector and the rear end of the connector, and the inner side of the opening end of the protector is pushed to the rear end of the connector through the distal end of the rubber boot by the binding force of the binding band which is mounted into the groove.

3. The protector-attached connector according to claim 1, further comprising a locking frame to which a locking part of a band body of the binding band is locked while the band body of the binding band is inserted to a part of the groove.

4. The protector-attached connector according to claim 1, wherein the protector is constructed by a cover and a protector body which are vertically divided in a direction perpendicular to the thickness direction, and the gaps that are formed when the opening end is fitted to the rear end of the connector are defined at a part where the cover and the protector body are bonded.

5. The protector-attached connector according to claim 1, wherein the gaps are narrowed by approximately the same distance by the binding force of the binding band when the binding band is mounted into the groove.

6. The protector-attached connector according to claim 4, wherein the cover and body are configured such that the lengths of the gaps remain substantially the same as the cover and body are moved toward or away from each other.

7. The protector-attached connector according to claim 1, wherein the protector is configured to define a substantially rectangular cross-section taken along a plane parallel to the connecting direction.

8. The protector-attached connector according to claim 1, wherein all of the opposing surfaces are planar.

* * * * *